US005614267A

United States Patent [19]

Howlett

[11] Patent Number: 5,614,267

[45] Date of Patent: Mar. 25, 1997

[54] REPAIR OF WORN CONVEYOR BELTING USING THERMALLY APPLIED POLYMER COATINGS

[75] Inventor: Marvin Howlett, Marshall, Tex.

[73] Assignee: Eutectic Corporation, Charlotte, N.C.

[21] Appl. No.: 594,273

[22] Filed: Jan. 30, 1996

[51] Int. Cl.[6] ..... B05D 1/08

[52] U.S. Cl. ..... 427/447; 198/847; 198/957; 474/261; 474/264

[58] Field of Search ..... 427/447; 198/846, 198/847, 957; 474/261, 264

[56] References Cited

U.S. PATENT DOCUMENTS

| | | | |
|---|---|---|---|
| 2,805,182 | 9/1957 | Hallenbeck | 474/264 |
| 4,674,622 | 6/1987 | Utsunomiya | 198/847 |
| 4,823,942 | 4/1989 | Martin et al. | 198/847 |

*Primary Examiner*—Katherine A. Bareford
*Attorney, Agent, or Firm*—Hopgood, Caliamfde, Kalil & JUdlowe

[57] ABSTRACT

A method and a product are provided for improving the resistance to abrasion of a load-carrying surface of a conveyor belt formed of a cord-reinforced elastomer material selected from the group consisting of natural and synthetic rubber, the belt being adapted for use for conveying particulate ore or other particulate material having abrasive properties. The method employed comprises cleaning the surface of the conveyor belt prior to coating the same with an abrasion resistant coating. The conveyor belt is characterized by a distribution of pores in the surface to be coated. A flexible coating of a polymer selected from the group consisting of polyolefins and polyester elastomers is flame sprayed in the molten state onto the conveyor belt surface using a flame spray torch. The flame of the torch is spaced from the conveyor surface to avoid contacting of the flame with the surface being coated. The coated conveyor belt is then cooled to provide a flexible polymer coating strongly bonded chemically to the surface and additionally mechanically bonded thereto by virtue of the coating material entering the pores of the surface of the belt and thereby mechanically locking the coating to the conveyor belt surface.

6 Claims, 1 Drawing Sheet

REPAIR OF WORN CONVEYOR BELTING USING THERMALLY APPLIED POLYMER COATINGS

This invention relates to the repair of worn conveyor belts caused by the deposit thereon of abrasive particulate material, such as coal, ore, and the like materials, for transportation thereof to a predetermined destination.

STATE OF THE ART

Conveyor belts employed in the transportation of abrasive particulate material, such as particulate coal, ore, etc., from mines, storage depots, or other sources of particulate material, such as at railroad sidings, are generally comprised of cord reinforced rubber or synthetic rubber, said belts having a load-carrying surface subjected to wear during use.

According to Kent's Mechanical Engineers' Handbook (1955 ed.), rubber belts are generally comprised of layers of cotton duck cemented together by rubber compounds and then vulcanized.

Lengthwise threads or cords of the cotton duck are heavier than the crosswise threads to give tensile strength with flexibility to provide troughing of the load-carrying surface upon which particulate abrasive material is deposited and held in place. Generally, an extra thickness or cover of rubber is provided on the load carrying side in order to increase its life, although the rubber conveyor is still subject to wear and tear. Rubber conveyors are characterized at the load-carrying surface therefor by a distribution of sub-surface pores which are produced during the making of a conveyor belt.

It would be desirable to provide a method for repairing a worn conveyor belt.

OBJECTS OF THE INVENTION

It is an object of the invention to provide a method for repairing a worn conveyor belt by the application to the worn surface a layer of a thermally applied polymer, i.e., polyester compound, resistant to wear.

Another object of the invention is to provide as an article of manufacture a conveyor belt of cord-reinforced elastomeric material, such as rubber, characterized by a polymer layer, e.g., a polyester coating, on a load carrying surface thereof to impart to said conveyor an improved wear resistant surface.

These and other objects will more clearly appear from the disclosure, the claims and the accompanying drawings.

THE DRAWINGS

Figure 1:
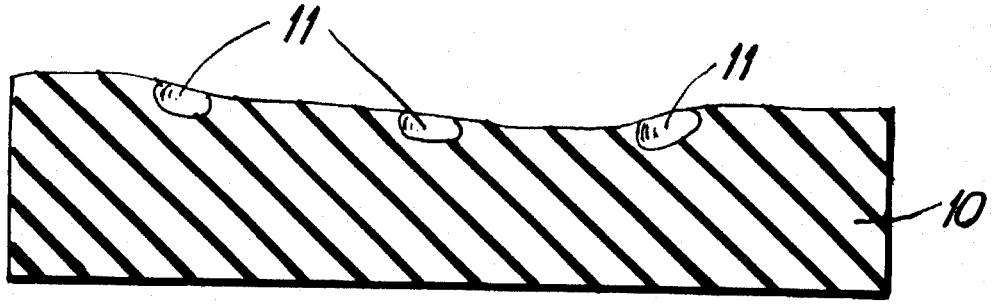
Figure 2:
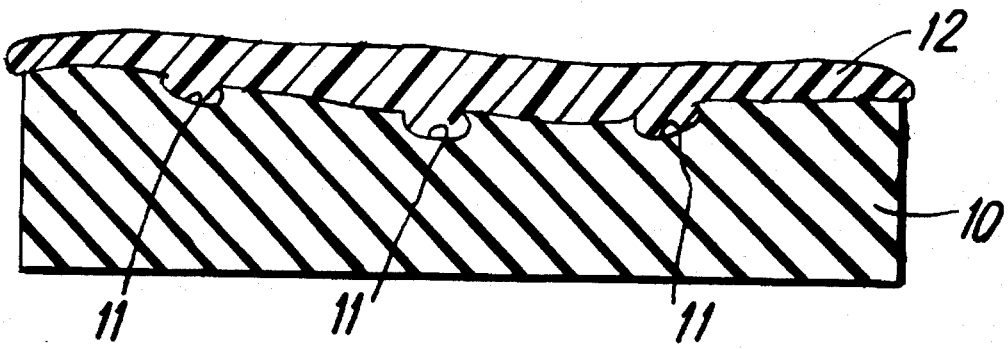
Figure 3:
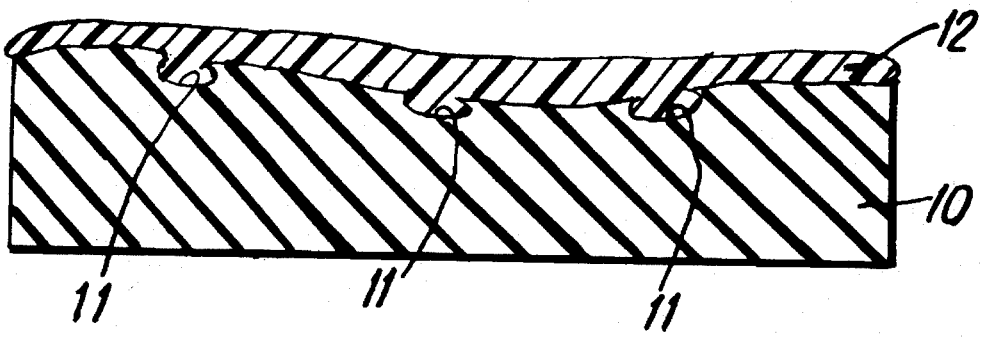

FIG. 1 is a cross section of a rubber conveyor belt 10 showing schematically sub-surface porosity 11 at a load-carrying surface of said conveyor belt;

FIG. 2 is similar to FIG. 1 and shows a wear resistant polyester layer 12 flame sprayed in the molten condition on the surface of said belt, the applied molten coating causing said sub-surface pores to open and allow entry of molten coating 12 into the interstices thereof; and FIG. 3 is similar to FIG. 2 and shows a cross section of the coated belt following cooling of the coating and shrinkage of the pores to mechanically bond the coating to surface in addition to the coating being chemically bonded to the belt.

SUMMARY OF THE INVENTION

One embodiment of the invention resides in a method of producing a wear resistant polymer or polyester coating on a cord-reinforced rubber conveyor belt, including belts made of synthetic rubber. The term "rubber" used herein is meant to include both natural rubber and synthetic rubber and other elastomeric materials.

The method comprises cleaning the surface of the conveyor belt prior to coating the same with an abrasion resistant coating. The rubber cord-reinforced conveyor belt is characterized by a distribution of sub-surface pores along the surface to be coated. Following cleaning of the surface of the belt a flame sprayed coating of a polymer selected from the group consisting of polyolefins and polyester elastomers is applied in the molten state to the load-carrying surface of the conveyor belt using a flame spray torch. To avoid overheating of the rubber substrate, the flame of the torch is spaced from the conveyor surface at a distance to avoid contact of the flame with the surface being coated; and the flame sprayed coating thereafter cooled to a solid state.

The polymer coating in the final product is flexible and strongly bonded chemically to the surface of the belt and additionally mechanically bonded thereto by virtue of the coating material entering the pores which open up on said surface and then shrink following cooling and thereby mechanically lock the coating to the load-carrying conveyor belt surface.

Polyolefins include those selected from the group consisting of polyethylene, polypropylene, ethyl vinyl acetate, polyallomer polybutylene and polymethyl pentene.

A preferred polyester elastomeric coating is that selected from the group consisting of polybutylene terephthalate mixed with a long chain polyether glycol, ethylene vinyl alcohol, ethylene acrylic acid and ethylene methacrylic acid.

In general, polyolefins and their copolymers have melting points of less than 350° F. and in most cases less than 225° F. They produce thermal spray coatings with excellent flexibility, toughness, tear resistance and adhesion Another embodiment of the invention resides in an article of manufacture produced by the invention, namely, a polymer-coated conveyor belt in which the load-carrying surface is characterized by a dispersion of sub-surface pores which open up and provide means for mechanically locking the coating, the coating being chemically bonded as well.

DETAILS OF THE INVENTION

In carrying the invention into practice, the worn conveyor belt is cleaned by using dry, oil-free air to remove loose debris plus manual dusting with a clean dry rag. Thus, in preparing the surface of a used conveyor belt, all that is required is to blow-off any loose debris followed by wiping the surface with a clean, dry cloth. However, where a substantially new belting is to be treated, particularly those having a shiny, glazed layer as the surface thereof, it is preferred that the shiny or glazed layer be roughened using a sanding belt of other means of roughing the surface. However, from a practical view point, there is little reason to coat a new belt.

In most thermal spray applications involving the coating of hard materials, such as a metal surface, good bonding is achieved by first roughening the base material to enhance mechanical bonding between the coating and the metal substrate.

In the case of rubber belting, the only preparation is cleaning the surface of all debris. Thus, acceptable bonding strength would have to be achieved by means of another mechanism.

Generally speaking, rubber conveyor belts can range in length of upwards of 600 feet and a width of about 6 feet. The belt is supported on rollers which are arranged along and beneath the length of the belt, the rollers being disposed across the width of the belt one with respect to the other to provide a center trough on the belt while supported by the rollers. For a 6-foot wide belt, the center trough is about two feet wide or more. When the hard particulate material is deposited on the belt, it locates itself gravimetrically within the trough along which wear occurs.

We discovered that good bonding can be achieved both by chemical bonding and by mechanical bonding.

As stated hereinbefore, the load-carrying surface of the rubber belting is characterized by a distribution of subsurface pores along the length thereof (note FIG. 1) which open up when contacted by a hot molten layer of said polyester compound, whereby the molten layer infiltrates into the open pores such that when the coated substrate cools to ambient temperature, the pores with the captured polyester compound shrink as shown in FIG. 3 to provide mechanical bonding of the layer together with chemical bonding of the layer in the areas surrounding the pores.

As illustrative of the invention, the following examples are given:

EXAMPLE 1

A polyester composition identified as CPM 1898 (a product produced by the Eutectic Corporation, herein the assignee) is employed comprising polybutylene terephthalate mixed with a long chain polyether glycol.

The coating material is provided in the form of pellets which may include the addition of an ultra violet stabilizer produced by Dupont and identified by the trade name Hytrel 20 uv.

A small but effective amount of an inorganic pigment may also be included, for example, a blue pigment comprising cobalt aluminum oxide which is dispersed through the polymer composition.

A specific flame spray composition comprises the following:

| Polyester | Cobalt Aluminum Oxide | Stabilizer |
|---|---|---|
| 110 lbs. | 2.2 lbs. | 4.4 lbs |
| 94.3% | 1.9% | 3.8% |

which composition is referred to as CPM 1898 (Eutectic Designation).

The foregoing mixture is comminuted to produce a particle size distribution falling with the following target size:

| | |
|---|---|
| +60 mesh | 0% |
| +70 mesh | 3% max. |
| −70 mesh | balance |
| +325 mesh | |
| −325 mesh | 10% max. |

A specific flame spray composition falling within the aforementioned target size range is flame sprayed using a TERODYN System developed by the Eutectic Corporation comprising:

(1) The system comprises a Hand-Held Torch which utilizes air plus a fuel gas (e.g. propane, propylene and natural gas) which develops from 25,000 to 60,000 BTU's per hour;

(2) A powder feed canister consisting of two chambers—a lower chamber which receives air and distributes it through a porous membrane to an upper chamber which contains the powder which air creates a fluidized bed; and (3) Hoses and regulators to complete the system. The gas employed for flame spraying may be any one or mixtures of the following:

Propane which is essentially $C_3H_8$

Natural gas which is essentially $CH_4$

Propylene gas which is essentially $C_3H_6$

The melting point of the composition (i.e., CPM 1898) ranges from about 335°–340° F. (168° c.–171° C.). The temperature of the polyester composition prior to striking the rubber substrate is above its melting point.

The coated product using the CPM 1898 composition is comprised of polybutylene terephthalate mixed with a long chain glycol.

Following cooling of the rubber substrate, the material is cross-sectioned and examined under the microscope at 10 times magnification to reveal a well-bonded structure.

A test was conducted on the final product which comprised pulling the layers apart to determine the strength of the bond. Generally speaking, a strong bond is evidenced by the fact that in separating the polyester layer from the rubber substrate, the rubber adheres to the polyester coating and tears itself from the rubber substrate.

As a further illustration of applicants' novel inventive concept, the following additional examples are given:

EXAMPLE 2

A coating is produced using ethylene vinyl alcohol as the polymer layer. A powder of this compound is sized to produce a flowable powder for flame spraying as in Example 1 and the powder flame sprayed using the conditions set forth in Example 1 to produce a wear resisting coating strongly bonded to the rubber belt. Ethylene vinyl alcohol has a melting point in the range of about 221° F. to 226° F. (105°–108° C.).

EXAMPLE 3

Another polymer coating material which may be employed in carrying out applicants' novel inventive concept is ethylene acrylic acid (referred to as EAA). The EAA compound in powder form is sized to produce a flowable flame spray powder using the conditions set forth in Example 1. The EAA compound has a melting point of about 194° F. to 210° F. (90°–99° C.).

EXAMPLE 4

A particularly useful polymer composition is ethylene methacrylic acid. The composition is provided in the particle size range falling within the target range set forth hereinbefore. The polyester compound has a melting range of about 221° F. to 239° F. (105° to 115° C.).

The powder is flame sprayed onto a cleaned surface of a cord-reinforced rubber substrate to produce a strongly adhering coating bonded both chemically and mechanically to the cord-reinforced rubber substrate.

Although the present invention has been described in conjunction with preferred embodiment, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. A method for improving resistance to abrasion of a load-carrying surface of a conveyor belt formed of a cord-reinforced elastomer material selected from the group consisting of natural and synthetic rubber, said belt being adapted for use for conveying particulate ore having abrasive properties or other particulate material having abrasive properties which comprises:

cleaning the load-carrying surface of said conveyor belt prior to coating the same with an abrasion resistant coating;

said conveyor belt being characterized by a distribution of pores in said surface to be coated; flame spraying a coating of a molten polymer selected from the group consisting of polyolefins and polyester elastomers onto said conveyor belt load-carrying surface using a flame spray torch;

the flame of said torch being spaced from the conveyor surface to avoid contact of the flame with the surface being coated; and cooling said coated conveyor belt;

whereby said polymer coating is bonded chemically to said load-carrying surface and additionally mechanically bonded thereto by virtue of said coating material entering the pores on said surface and thereby mechanically locking the coating to said conveyor belt surface upon cooling of said coating.

2. The method of claim 1 wherein said polyolefins are selected from the group consisting of polyethylene, polypropylene, ethyl vinyl acetate, polyallomer polybutylene and polymethyl pentene.

3. The method of claim 1, wherein said polymer coating is selected from the group consisting of polybutylene terephthalate mixed with a long chain polyether glycol, and from polymers of ethylene vinyl alcohol, ethylene acrylic acid and ethylene methacrylic acid.

4. The method of claim 3, wherein said polymer coating is polybutylene terephthalate mixed with a long chain polyether glycol.

5. The method of claim 3, wherein said polymer coating has an inorganic color pigment dispersed therethrough.

6. The method of claim 5, wherein said inorganic pigment is cobalt aluminum oxide.

* * * * *